US008912723B2

(12) United States Patent
Liao et al.

(10) Patent No.: US 8,912,723 B2
(45) Date of Patent: Dec. 16, 2014

(54) METHOD, DEVICE FOR DRIVING LIGHT MODULATION AND LIGHT MODULATION LAMP THEREOF

(75) Inventors: Yingwen Liao, Shenzhen (CN); Lin Feng, Shenzhen (CN); Xiaoyu Wang, Fuyang (CN)

(73) Assignee: Lin Feng, ShenZhen, GuangDong Province (CN)

( * ) Notice: Subject to any disclaimer, the term of this patent is extended or adjusted under 35 U.S.C. 154(b) by 205 days.

(21) Appl. No.: 13/699,623

(22) PCT Filed: Jun. 28, 2010

(86) PCT No.: PCT/CN2010/074563

§ 371 (c)(1), (2), (4) Date: Feb. 6, 2013

(87) PCT Pub. No.: WO2011/143839

PCT Pub. Date: Nov. 24, 2011

(65) Prior Publication Data

US 2013/0200793 A1 Aug. 8, 2013

(30) Foreign Application Priority Data

May 21, 2010 (CN) ..... 2010 1 0179404

(51) Int. Cl.
*H05B 37/02* (2006.01)
*H05B 33/08* (2006.01)

(52) U.S. Cl.
CPC ..... *H05B 37/0209* (2013.01); *H05B 33/0845* (2013.01)
USPC ..... 315/86; 315/209 R; 315/224; 315/307; 315/308; 362/20; 362/276

(58) Field of Classification Search
CPC ..... H05B 33/0854; H05B 33/0803; H05B 33/0815; H05B 33/0842; H05B 33/0845; H05B 33/0848; H05B 37/0272; H05B 37/03; H05B 37/02
USPC ..... 315/86, 307, 209 R, 224, 225, 172, 308
See application file for complete search history.

(56) References Cited

U.S. PATENT DOCUMENTS

2010/0052574 A1* 3/2010 Blakeley et al. ..... 315/307
2010/0271802 A1* 10/2010 Recker et al. ..... 362/20

* cited by examiner

*Primary Examiner* — Thienvu Tran
*Assistant Examiner* — Christopher Lo

(57) ABSTRACT

A method for driving light adjustments, a device therefor and a light adjustable lamp including the device are disclosed. The device includes a light source driving circuit, an MCU and a temporary power supplying circuit. The MCU includes a current detecting module, an analyzing and processing module and a storage module. The analyzing and processing module obtains a connecting signal or a disconnecting signal of the light source driving circuit and thereafter extracts a stored firmware program of gradually varying brightness of a light source or stored information about a constant brightness state of the light source from the storage module for analyzing and processing, so as to generate a controlling signal of adjusting the brightness of the light source and send the controlling signal into the light source driving circuit. Then the light source driving circuit adjusts the brightness of the light source according to the controlling signal.

11 Claims, 3 Drawing Sheets

METHOD, DEVICE FOR DRIVING LIGHT MODULATION AND LIGHT MODULATION LAMP THEREOF

CROSS REFERENCE OF RELATED APPLICATION

This is a U.S. National Stage under 35 U.S.C 371 of the International Application PCT/CN2010/074563, filed Jun. 28, 2010, which claims priority under 35 U.S.C. 119(a-d) to CN 201010179404.3, filed May 21, 2010.

BACKGROUND OF THE PRESENT INVENTION

1. Field of Invention

The present invention relates to a lighting lamp control technology, and more particularly to a method for driving light adjustments, a device therefor and a light adjustable lamp comprising the device, wherein the device is in a combination with an on-off switch to control and adjust brightness of a light source.

2. Description of Related Arts

Under an increasing shortage of energy resources, the energy saving of the lamps are becoming more and more important. Conventionally, the energy saving of lighting lamps mainly aims at replacing conventional incandescent lamps with energy-saving lamps, such as the fluorescent lamps and the LED, and pays little attention to the light adjustment technology which effectively saves energy by duly adjusting brightness of the lamps. On one hand, researches about the light adjustment technology are few; on the other hand, consumers have the demand of light adjustment technology, but have no technical supports. When purchasing the lighting lamps, the consumers are always bothered about choosing what power of the lamps to satisfy lighting demand; and after the lamps with certain power are purchased, a dilemma that most of such high power is unnecessary often occurs. Moreover, the conventional home lighting lamps only have switching functions without light adjustments and thus the lamps have to be switched on even if only dim light is demanded, which results in a great waste. Existing bedside lamps at some hotels have functions of adjusting brightness, but the brightness adjustments are accomplished via knobs, which is basically impossible for home lighting because most existing home walls are only installed with on-off switches, instead of the knobs, to switch off the lamps. Further, if the knobs are used for the light adjustments, the common on-off switches are required to be replaced with the knobs, which adds many engineering costs; because of potential danger of electric shock during replacing the switches, professional electricians are needed to do the replacing, which undoubtedly further adds labor cost of the replacing; and the on-off switches are abandoned while the knobs are used, which further increases product costs of the knobs. As a result, such a light adjustment technology is hardly widely applied on market unless for the lighting construction to-be-started. Some relatively advanced remote control light adjustment technologies also appear on market. The remote control light adjustment technologies require no extra construction and no labor costs of replacing, but it is difficult to keep remote controllers and turning on the lamps often fails because of the drained remote controllers.

The field of commercial lighting has the demand not only for the brightness adjustments, but also for color adjustments. Similarly, the color adjustments also require providing additional controlling devices rather than the on-off switches, which adds the costs of the light adjustment. Certainly, the home lighting also has potential demand of the color adjustments, but no conventional color adjustment technology via the on-off switches ever appears.

A Chinese patent having an application number of 200810135921.3, searched out by the inventor, discloses a device for driving light adjustments and a method therefor. The device cooperates with an LED driver and changes brightness via calculating a frequency of a switch switching between ON and OFF, so as to enable the LED driver to adjust light. The device is only able to discretely adjust the brightness because of calculating the frequency of the switch switching between ON and OFF to change the brightness. The brightness can be divided into several grades and each grade of brightness corresponds to a certain frequency of the switch switching between ON and OFF by the switch. The device is unable to linearly and freely adjust the brightness. Meanwhile, the brightness adjustment requires frequently switching between ON and OFF, leading to frequent lightening and extinguishing of LED lamps, which is cumbersome and uncomfortable for human eyes and, more importantly, reduces service lives of the lamps.

SUMMARY OF THE PRESENT INVENTION

An object of the present invention is to solve the above technical problems and provide a method for driving light adjustments, a device therefor and a light adjustable lamp thereof. The device for driving light adjustments cooperates with an on-off switch and by collecting on and off signals of a switch linearly and freely adjusts brightness of a light source correspondent to the on and off signals, which is simple and costs lowly. Moreover, during adjusting light, the light is kept from being extinguished, so as to bring convenience to the light adjustment without affecting a service life of the light source. Besides, the light adjustment is executed only when necessary; otherwise, a habit of a user's choices about the brightness is memorized to prevent the user from adjusting light each time the user turns on a lamp, which brings convenience to using.

The light source of the present invention comprises lamps which drive light sources of the lamps to work via electronic drivers, such as fluorescent lamps and LED lamps. A conventional technical solution of the inventor, earlier than the present invention, is showed specifically as follows.

A conventional method for driving light adjustments is provided. The conventional method comprises following steps of:

for a first time connecting a light source driving circuit which supplies a light source and a micro control unit (MCU) with electricity and then driving the light source to gradually vary brightness according to a predefined firmware program by the light source driving circuit which is controlled by the MCU;

continuing to supply the MCU with electricity by a temporary power supplying circuit after the light source driving circuit is disconnected;

the MCU obtaining a temporary brightness state at the instant of disconnecting the light source driving circuit and then the MCU temporarily storing information about the brightness state when the light source is in a state of gradually varying the brightness and at the instant of disconnecting the light source driving circuit;

connecting the light source driving circuit before the information about the brightness state vanishes and driving the light source to work constantly according to the information about the brightness state by the light source driving circuit which is controlled by the MCU;

connecting the light source driving circuit after the information about the brightness state vanishes and driving the light source to gradually vary the brightness according to the predefined program by the light source driving circuit which is controlled by the MCU; and after the temporary power supplying circuit stops supplying the MCU with electricity, the stored information about the brightness state vanishing.

The light source driving circuit of the conventional method is accompanied by an energy storing element which continues to supply the light source with electricity after the light source driving circuit stops supplying the light source with electricity.

The energy storing element of the conventional method comprises one kind or more than one kind of capacitors, inductors and cells.

The conventional method further comprises following steps of:

when the light source is working at the constant brightness state and before the information about the constant brightness state vanishes, disconnecting the light source driving circuit and the MCU eliminating the stored information about the constant brightness state.

The step of "the MCU obtaining a temporary brightness state at an instant of disconnecting the light source driving circuit and the MCU temporarily storing information about the brightness state when the light source is in a state of gradually varying the brightness and at the instant of disconnecting the light source driving circuit specifically" comprises following steps of:

when the light source is in the state of gradually varying the brightness and at the instant of disconnecting the light source driving circuit, the MCU obtaining a period of the light source driving circuit from connecting to disconnecting, then searching out a light source constant brightness state correspondent to the period in the predefined program and temporarily storing information about the constant brightness state.

The step of "the MCU obtaining a temporary brightness state at an instant of disconnecting the light source driving circuit and the MCU temporarily storing information about the brightness state when the light source is in a state of gradually varying the brightness and at the instant of disconnecting the light source driving circuit" specifically comprises following steps of:

when the light source is in the state of gradually varying the brightness and at the instant of disconnecting the light source driving circuit, the MCU obtaining at least one of a current value and a voltage value at an output terminal of the light source driving circuit when the light source driving circuit is disconnected and then temporarily storing the obtained value or values.

The conventional method has following disadvantages.

A user certainly switches off to turn off the light source when needing no lighting; but if the switch has been off for a long time, the light source driving circuit is unable to supply the MCU with electricity for a long time and then the temporary power supplying circuit is doomed to be drained. As a result, the information about the brightness state stored by the MCU can disappear. When the user switches on after the long-time switching off, the light source returns to the state of gradually varying the brightness and remains to be adjusted again by the user. If each time switching on requires the light adjustment, undoubtedly it is increasing inconvenient to use, while in most cases the user only demands fixed brightness. Thus according to the above problems, a method of the present invention, as an improvement of the conventional method, is described as follows.

The method for driving light adjustments of the present invention comprises following steps of:

for a first time connecting a light source driving circuit which supplies a light source and an MCU with electricity and then driving the light source to gradually vary brightness by the light source driving circuit which is controlled by the MCU;

after the light source driving circuit is disconnected, continuing to supply the MCU with electricity by a temporary power supplying circuit;

when the light source is in a state of gradually varying the brightness and at an instant of disconnecting the light source driving circuit, the MCU obtaining a temporary brightness state at the instant of disconnecting the light source driving circuit and then temporarily storing information about the brightness state;

when the light source driving circuit is disconnected while the light source is in the state of gradually varying the brightness and after the temporary power supplying circuit stops supplying the MCU with electricity, the temporarily stored information about the brightness state vanishing;

again connecting the light source driving circuit after the first time before the information about the brightness state vanishes, driving the light source to work according to the information about the brightness state by the light source driving circuit which is controlled by the MCU and then the MCU stably storing the information about the brightness state;

again connecting the light source driving circuit after the first time after the information about the brightness state vanishes and driving the light source to gradually vary the brightness according to the predefined program by the light source driving circuit which is controlled by the MCU;

disconnecting the light source driving circuit when the light source is working at the brightness state which is constant, thereafter connecting the light source driving circuit before the temporary power supplying circuit stops supplying the MCU with electricity and then the MCU eliminating the stably stored information about the brightness state when the light source driving circuit is connected;

disconnecting the light source driving circuit when the light source is working at the brightness state which is constant, thereafter connecting the light source driving circuit after the temporary power supplying circuit stops supplying the MCU with electricity and then the MCU saving the stably stored information about the brightness state;

connecting the light source driving circuit after the information about the brightness state is eliminated and driving the light source to gradually vary the brightness according to the predefined program by the light source driving circuit which is controlled by the MCU; and connecting the light source driving circuit after the information about the brightness state is saved and driving the light source to work according to the stably stored information about the brightness state by the light source driving circuit which is controlled by the MCU.

The light source driving circuit is accompanied by an energy storing element which continues to supply the light source with electricity after the light source driving circuit stops supplying the light source with electricity.

The step of "when the light source is in a state of gradually varying the brightness and at an instant of disconnecting the light source driving circuit, the MCU obtaining a temporary brightness state at the instant of disconnecting the light source driving circuit and then temporarily storing information about the brightness state" specifically comprises following steps of:

when the light source is in the state of gradually varying the brightness and at the instant of disconnecting the light source driving circuit, the MCU obtaining a period of the light source driving circuit from connecting to disconnecting, then searching out a light source constant brightness state correspondent to the period in the predefined program and temporarily storing information about the constant brightness state.

The step of "when the light source is in a state of gradually varying the brightness and at an instant of disconnecting the light source driving circuit, the MCU obtaining a temporary brightness state at the instant of disconnecting the light source driving circuit and then temporarily storing information about the brightness state" specifically comprises following steps of:

when the light source is in the state of gradually varying the brightness and at the instant of disconnecting the light source driving circuit, the MCU obtaining at least one of a current value and a voltage value at an output terminal of the light source driving circuit when the light source driving circuit is disconnected and then temporarily storing the obtained value or the obtained values.

Besides the above method for driving light adjustments, the present invention also provides a device for driving light adjustments comprising a light source driving circuit. The device further comprises an MCU and a temporary power supplying circuit for continuing to supply the MCU with electricity after the light source driving circuit stops supplying electricity. The MCU comprises a current detecting module, an analyzing and processing module and a storage module. The current detecting module is for obtaining a connecting signal or a disconnecting signal of the light source driving circuit and sending the obtained signal into the analyzing and processing module. The storage module is for storing a firmware program of gradually varying brightness of a light source and information about constant brightness state of the light source. The analyzing and processing module is for obtaining the connecting signal or the disconnecting signal of the light source driving circuit and the firmware program of gradually varying the brightness of the light source or the information about the constant brightness state of the light source stored in the storage module for analyzing and processing, generating a signal of adjusting the brightness of the light source and sending the signal into the light source driving circuit. The light source driving circuit adjusts the brightness of the light source according to the signal, specifically as follows:

after the light source driving circuit is connected for a first time, the analyzing and processing module generating a signal for controlling the light source driving circuit to drive the light source to gradually vary the brightness according to the predefined firmware program;

when the light source is in a state of gradually varying the brightness and after the light source driving circuit is disconnected, the analyzing and processing module obtaining a constant brightness state at an instant of disconnecting the light source driving circuit and then temporarily storing information about the constant brightness state in the storage module;

when the light source driving circuit is disconnected while the light source is in the state of gradually varying the brightness and after the temporary power supplying circuit stops supplying the MCU with electricity, the temporarily stored information about the constant brightness state vanishing;

again connecting the light source driving circuit after the first time before the information about the constant brightness state vanishes, then the analyzing and processing module generating the signal for controlling the light source driving circuit to drive the light source to work according to the information about the constant brightness state and then stably storing the information about the constant brightness state in the storage module;

again connecting the light source driving circuit after the first time after the information about the constant brightness state vanishes and then the analyzing and processing module generating the signal for controlling the light source driving circuit to drive the light source to gradually vary the brightness according to the predefined program;

when the light source is working at the constant brightness state, disconnecting the light source driving circuit and then connecting the light source driving circuit before the temporary power supplying circuit stops supplying the MCU with electricity, and the analyzing and processing module eliminating the stably stored information about the constant brightness state when the light source driving circuit is connected;

when the light source is working at the constant brightness state, disconnecting the light source driving circuit and then connecting the light source driving circuit after the temporary power supplying circuit stops supplying the MCU with electricity, and then the analyzing and processing module saving the stably stored information about the constant brightness state;

connecting the light source driving circuit after the information about the constant brightness state is eliminated and the analyzing and processing module generating the signal for controlling the light source driving circuit to drive the light source to gradually vary the brightness according to the predefined program; and connecting the light source driving circuit after the information about the constant brightness state is saved and the analyzing and processing module generating the signal for controlling the light source driving circuit to drive the light source to work according to the stably stored information about the constant brightness state.

The MCU further comprises a timing module for obtaining a period of the light source driving circuit from connecting to disconnecting when the light source is in the state of gradually varying the brightness and at the instant of disconnecting the light source driving circuit; and then the analyzing and processing module searches out a constant brightness state of the light source corresponding to the period in the predefined program and then temporarily stores information about the constant brightness state.

The MCU further comprises a sampling module for obtaining at least one of a current value and a voltage value at an output terminal of the light source driving circuit when the light source is in the state of gradually varying the brightness and an the instant of disconnecting the light source driving circuit and sending the obtained value or the obtained values into the analyzing and processing module; and then the analyzing and processing module stores the value or the values in the storage module.

The present invention also provides a light adjustable lamp comprising a light source and a device for driving light adjustments connected to the light source, wherein the device for driving light adjustments is as described above.

The energy storing element comprises one kind or more than one kind of capacitors and inductors.

The present invention has following beneficial technical effects.

The MCU of the present invention generates the signal for controlling the brightness of the light source by obtaining ON and OFF signals of an on-off switch which is connected to the light source driving circuit, i.e., by obtaining the connecting signal or the disconnecting signal of the light source driving circuit and outputs the signal for controlling the brightness of the light source to the light source driving circuit, which is an ingenious manner and forms simple structures without being provided with additional knobs or remote controllers for the light adjustments, so as to greatly reduce an improvement cost of conventional lighting lamps.

When the on-off switch is off, the energy storing element of the light source driving circuit continues to supply the light source with electricity, so that the light source keeps constant brightness within the period of switching actions instead of going out after the on-off switch is off, which ensures a continuous electricity supply to users and brings convenience to the light adjustments.

A continuous linear light adjustment can be accomplished by choosing only once, either by choosing a desired brightness instead of frequently switching between ON and OFF to simplify controlling, or by freely controlling the brightness of the light source. The continuous linear light adjustment is more advanced compared to conventional arts.

Besides, the light adjustments are required only when necessary; otherwise habits of choices made by a user are memorized when unnecessary to avoid adjusting lights every time the user turns on the lamp and bring convenience to using.

These and other objectives, features, and advantages of the present invention will become apparent from the following detailed description, the accompanying drawings, and the appended claims.

DETAILED DESCRIPTION OF THE PREFERRED EMBODIMENT

The present invention provides a method for driving light adjustments, a device therefor and a light adjustable lamp comprising the device. The device cooperates with an on-off switch and collects an OFF signal of the switch to linearly and freely adjust brightness of a light source correspondent to the OFF signal. The method for driving light adjustments, the device therefor and the light adjustable lamp comprising the device of the present invention have a simple controlling manner and low costs, prevent lights from being extinguished during the light adjustments to bring convenience to the light adjustments without affecting a service life of the light source and have a memory of using habits to avoid frequently adjusting lights every time a user turns on.

Combined with preferred embodiments and drawings, the present invention is further illustrated and described as follows.

First Preferred Embodiment

Figure 1:
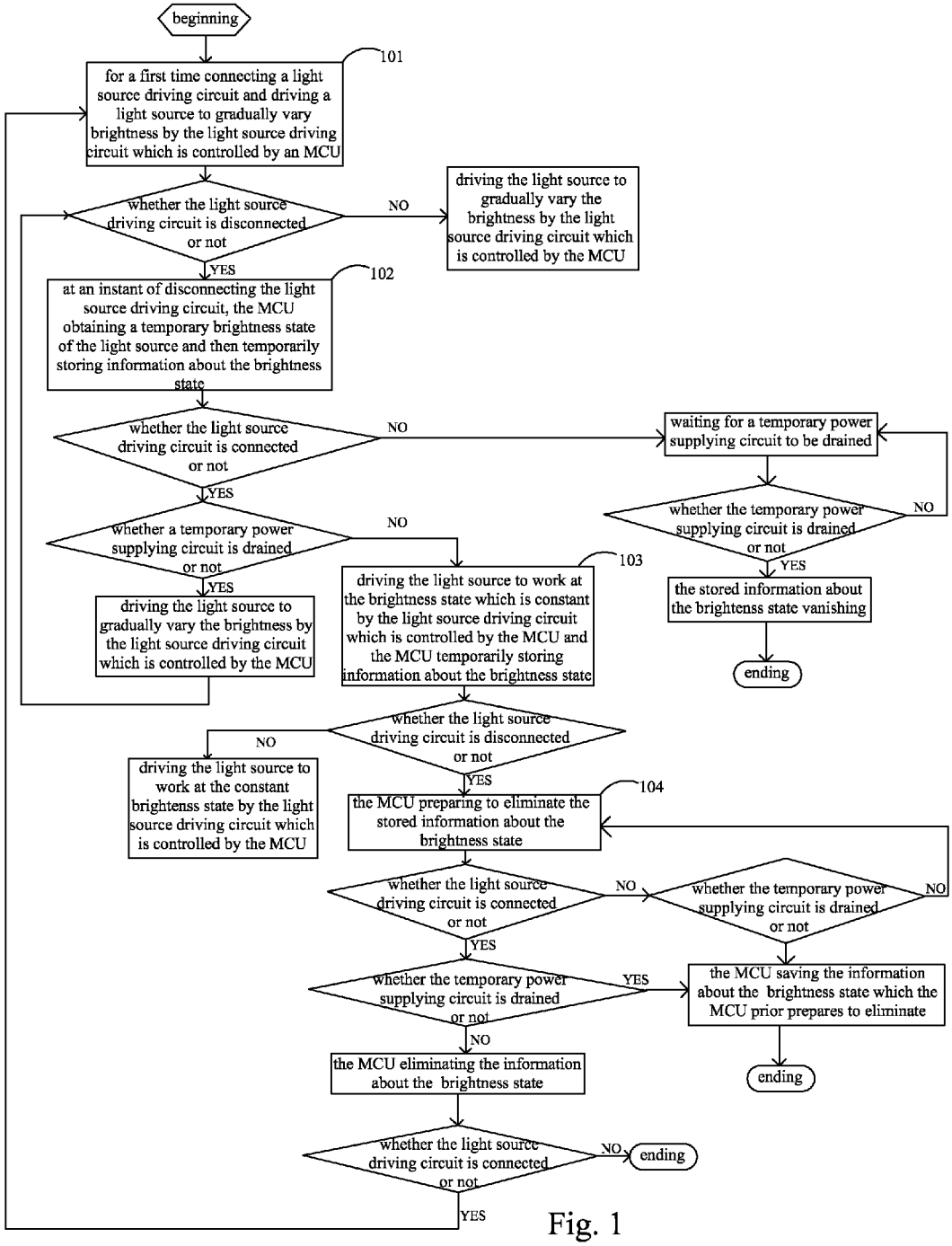
FIG. 1 is a flow chart of a method for driving light adjustments according to a first preferred embodiment of the present invention.
Figure 2:
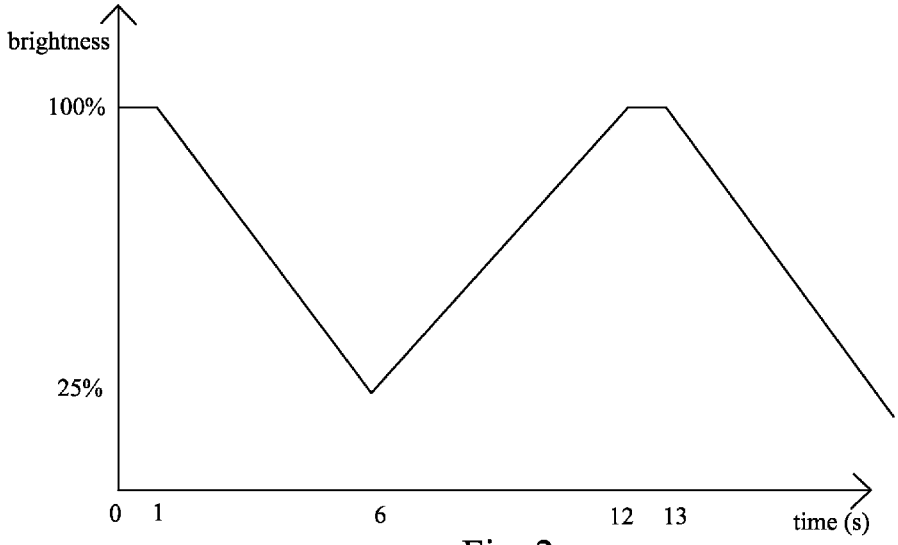
FIG. 2 is a curve diagram of brightness changes of a light source according to the first preferred embodiment of the present invention.

Referring to FIG. 1 of the drawings, according to of a first preferred embodiment of the present invention, a method for driving light adjustments which is based on sending a signal for controlling brightness of a light source into a light source driving circuit via an MCU to accomplish a control of the brightness of the light source specifically comprises following steps of:

101: connecting a light source driving circuit for a first time and driving a light source to gradually vary brightness by the light source driving circuit which is controlled by an MCU, specifically comprising: firming a program in the MCU, wherein the program corresponds to a controlling signal for driving the light source to work at a gradually varying state firstly from bright to dark and then from dark back to bright; connecting the light source driving circuit by turning on a switch of the light source driving circuit for a first time and then the light source driving circuit supplying the MCU and the light source with electricity; after the light source driving circuit is connected, the MCU starting to work while the light source lightens and driving the light source to work at a state varying from bright to dark and then from dark back to bright by the light source driving circuit which is controlled by the MCU, wherein FIG. 2 shows the varying order; before the switch is turned off, the light source keeping varying the brightness by repeating the varying order; and when the switch of the light source driving circuit is turned off, the light source stopping varying, wherein the controlling signal is a PWM controlling signal;

102: at an instant of disconnecting the light source driving circuit, the MCU obtaining a temporary brightness state of the light source and then temporarily storing information about the temporary brightness state, specifically comprising: when the light source is working at the state of gradually varying the brightness as mentioned in step 101, turning off the switch to disconnect the light source driving circuit so that the light source driving circuit stops supplying the MCU with electricity while a temporary power supplying circuit continues to supply the MCU with electricity to drive the MCU to continue working; the MCU obtaining a connecting signal or a disconnecting signal of the light source driving circuit by detecting a current signal of the light source driving circuit; and when the MCU detects that the light source driving circuit is disconnected, the MCU obtaining a period of the light source driving circuit from connecting to disconnecting, then according to the period searching out a brightness state of the light source at the instant of disconnecting the light source driving circuit in the firmware program and storing information about the brightness state, wherein a time of supplying the MCU with electricity by the temporary power supplying circuit depends on a discharging time of an energy storing element of the temporary power supplying circuit and the energy storing element can be inductors, capacitors or cells;

wherein after storing the information about the brightness state, the MCU awaits connecting the light source driving circuit again; if the light source driving circuit is connected again after the temporary power supplying circuit is drained, the stored information about the brightness state vanishes and then the light source driving circuit is controlled by the MCU to drive the light source to change at the state as mentioned in the step 101; and if the light source driving circuit is connected before the temporary power supplying circuit is drained, the stored information about the brightness state still exists and then the light source driving circuit is controlled by the MCU to drive the light source to work at a state as mentioned in step 103;

103: again connecting the light source driving circuit after the first time, driving the light source to work at the brightness state which is constant as mentioned in the step 102 by the light source driving circuit which is controlled by the MCU and the MCU stably storing the information about the brightness state, specifically comprising: turning on the switch before the temporary power supplying circuit is drained, i.e., before the temporary power supplying circuit drives the MCU to work, so as to connect the light source driving circuit, in such a manner that the light source driving circuit recovers supplying the MCU and the light source with electricity, which results in that the light source lightens again and the MCU continues working and detects that the light source driving circuit is connected; and in a situation that the firmware program and the information about the brightness state simultaneously exist, the MCU preferably collecting the stored brightness state and then analyzing the stored brightness state and driving the light source to work at the constant brightness state by the light source driving circuit which is controlled by the MCU, wherein the MCU stably stores the information about the brightness state when the light source works at the constant brightness state and the stably storing means that, even if the temporary power supplying circuit is drained, the stored information about the brightness state is still prevented from vanishing by storing the information about the brightness state in a flash memory chip; and

104: disconnecting the light source driving circuit when the light source is working at the constant brightness state, connecting the light source driving circuit after the light source driving circuit is disconnected and before the temporary power supplying circuit stops supplying the MCU with electricity and the MCU eliminating the stably stored information about the brightness state when the light source driving circuit is connected, specifically comprising: disconnecting the light source driving circuit when the light source is working at the constant brightness state and starting to load the MCU with an instruction of preparing to eliminate the stably stored information about the brightness state, wherein the instruction stays before the temporary power supplying circuit is drained and vanishes thereafter; when the instruction exists, once again connecting the light source driving circuit, and the MCU obtaining the connecting signal of the light source driving circuit and then readily eliminating the stably stored information about the brightness state; because the information about the brightness state is eliminated, the MCU sending a signal of driving the light source to work at the state of gradually varying the brightness into the light source driving circuit; and when the instruction vanishes, once again connecting the light source driving circuit and despite the MCU obtaining the connecting signal of the light source driving circuit, the stably stored information about the brightness state still being protected from being eliminated by the MCU because of the vanishing of the instruction of preparing to eliminate the stably stored brightness state, which means that the information about the brightness state still remains and thereby the MCU sends the signal of driving the light source to work at the state of constant brightness into the light source driving circuit.

The connecting for the first time means connecting the light source driving circuit after the stored information about the brightness state is eliminated. Certainly, when the light source is working at the constant brightness state and after the light source driving circuit is disconnected, it is unnecessary for the MCU not to save the stored information about the brightness state until the light source driving circuit is connected after the temporary power supplying circuit stops supplying the MCU with electricity. The MCU can save the stored information about the brightness state when the light source driving circuit maintains disconnected only for a certain period after being disconnected. The certain period can be different in specific situations and ranges approximately from 3 s to 10 s.

Following are some necessary illustration.

According to the first preferred embodiment of the present invention, the light source driving circuit supplies the MCU and the light source with electricity. After the switch is turned off, the light source driving circuit is switched off and stops supplying the light source with electricity; and further, each light adjustment requires turning off the switch, so as to further stop the light source from being supplied with electricity. If each light adjustment has to extinguish the light source, the light adjustment becomes a bother in users' work and life; and along with frequently switching on and off, it is certain that a service life of the light source is greatly shortened. Thus it is necessary to provide the energy storing element for temporarily supplying the light source with electricity after turning off the switch, which specifically comprises that the light source driving circuit is accompanied by the energy storing element and the energy storing element continues to supply the light source with electricity after the light source driving circuit stops supplying the light source with electricity. The energy storing element independently supplies the light source with electricity after the switch is turned off and then the light source driving circuit recharges the energy storing element after the switch is turned on; and thus the energy storing element is preferred to be the capacitors or the inductors. Because the energy storing element is designed to supply the light source with electricity, the light source maintains identical brightness even at the instant of turning off the switch; in other words, the light source has a current value and a voltage value unchanged. The energy storing element is provided at an output terminal of the light source driving circuit. Thus when the light source is in the state of gradually varying the brightness and at the instant of disconnecting the light source driving circuit, the MCU obtains at least one of the current value and the voltage value of the output terminal of the light source driving circuit at the instant, wherein the current value and the voltage value correspond to the brightness state of the light source when the light source driving circuit is disconnected; and the MCU temporarily stores the current value and the voltage value, which equals storing the information about the brightness state of the light source when the light source driving circuit is disconnected.

Second Preferred Embodiment

Figure 3:
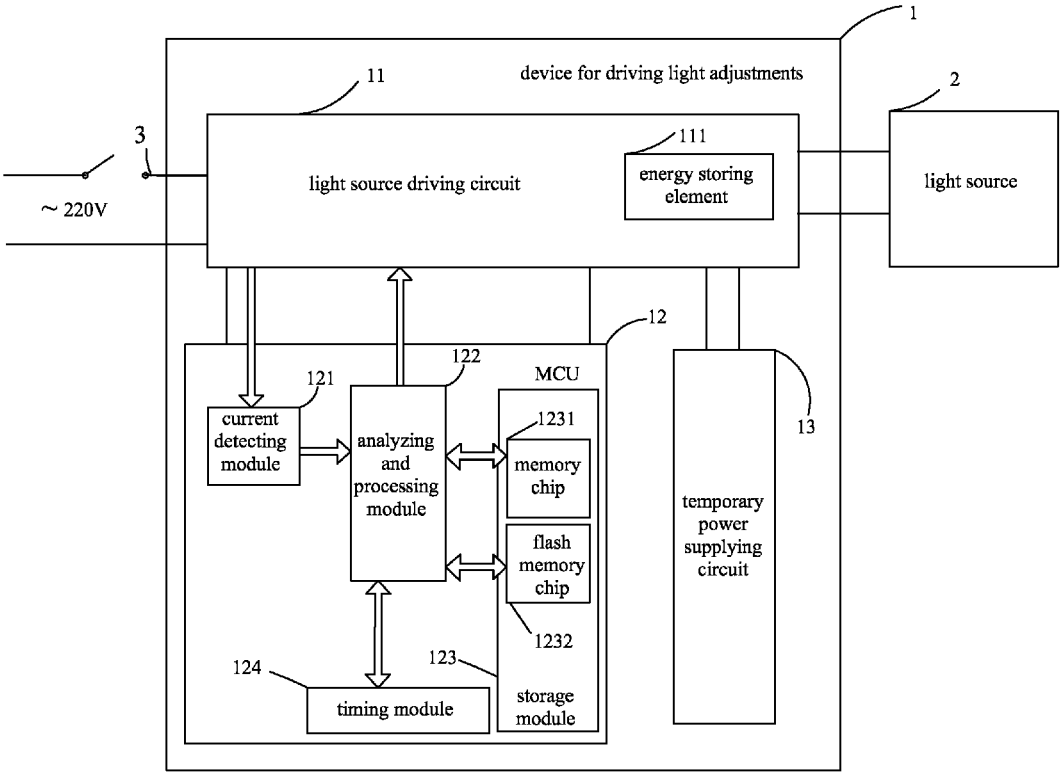
FIG. 3 is a block diagram of a light adjustable lamp according to a second preferred embodiment of the present invention.
Figure 4:
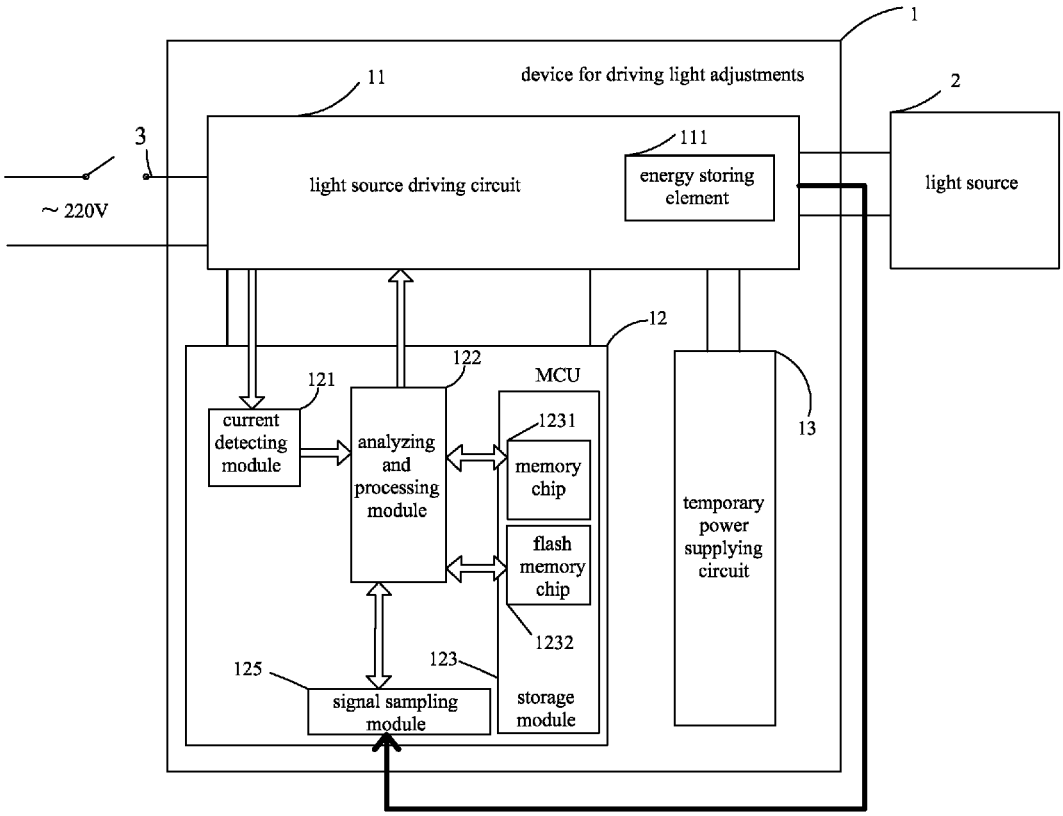
FIG. 4 is a block diagram of the light adjustable lamp according to a third preferred embodiment of the present invention.

Referring to FIG. 3, according to a second preferred embodiment of the present invention, a light adjustable lamp comprises a device for driving light adjustments 1 and a light source 2 connected to the device. The device is controlled by a switch 3. The device 1 comprises a light source driving circuit 11, an MCU 12 and a temporary power supplying circuit 13. The light source driving circuit 11 is for supplying the MCU 12 and the light source 2 with electricity. The temporary power supplying circuit 13 is for continuing to supply the MCU 12 with electricity after the light source driving circuit 11 stops supplying the MCU 12 with electricity. The light source driving circuit 11 is also for charging the temporary power supplying circuit 13. The light source driving circuit 11 is accompanied by an energy storing element 111 for continuing to supply the light source 2 with electricity after the switch 3 which is connected to the light source driving circuit 11 is turned off. The MCU 12 comprises a current detecting module 121, an analyzing and processing module 122 and a storage module 124, wherein the storage module comprises a memory chip 1231 and a flash memory chip 1232. The current detecting module 121 is for obtaining a connecting signal and a disconnecting signal of the light source driving circuit 11 and sending the obtained signal into the analyzing and processing module 122. The storage module 123 is for storing a firmware program of gradually varying brightness of the light source and information about constant brightness state of the light source. The analyzing and processing module 122 obtains the connecting signal or the disconnecting signal of the light source driving circuit 11 and the firmware program or the information stored in the storage module 123 to analyze and process, then generates a signal of adjusting the brightness of the light source and sends the signal into the light source driving circuit 11. The light source driving circuit 11 adjusts the brightness of the light source 2 according to the signal.

When the light source driving circuit is connected for a first time, the current detecting module 121 obtains a connecting signal of the light source driving circuit 11 and sends the connecting signal into the analyzing and processing module 122; the analyzing and processing module 122 obtains the connecting signal and extracts the firmware program of gradually varying the brightness of the light source in the storage module 123 to analyze and process, wherein an order of varying the brightness is showed in FIG. 2, and generates a controlling signal for controlling the light source driving circuit 11 to drive the light source 2 to gradually vary the brightness according to the predefined firmware program.

Third Preferred Embodiment

The MCU further comprises a timing module 124 for obtaining a period of the light source driving circuit 11 from connecting to disconnecting when the light source 2 is in the state of gradually varying the brightness and at an instant of disconnecting the light source driving circuit 11. The analyzing and processing module 122 searches a constant brightness state of the light source which corresponds to the period out in the predefined program and temporarily stores information about the constant brightness state in the memory chip 1231. The timing module 124 starts clocking after the light source driving circuit 11 is connected for the first time and stops clocking when disconnecting the light source driving circuit 11. When the light source driving circuit 11 is connected for the first time, the analyzing and processing module 122 obtains the connecting signal and sends a clocking instruction into the timing module 124. At the instant of disconnecting the light source driving circuit 11, the current detecting module 121 sends a signal of disconnecting the light source driving circuit 11 into the analyzing and processing module 122. The analyzing and processing module 122 obtains the disconnecting signal and sends an instruction of stopping clocking into the timing module 124. The timing module 124 counts period information from connecting to disconnecting and sends the period information into the analyzing and processing module 122. The analyzing and processing module obtains the period information, searches out the constant brightness state of the light source which corresponds to the period via a combination with the firmware program stored in the storage module 123 and stores the information about the constant brightness state in the memory chip 1231.

The light source driving circuit 11 is disconnected when the light source 2 is gradually varying the brightness; and when the temporary power supplying circuit 13 stops supplying the MCU 12 with electricity, the temporarily stored information about the brightness state vanishes.

After the switch 3 is turned on for the first time, the switch 3 is turned on again before the information about the brightness state vanishes. The analyzing and processing module 122 generates the signal of controlling the light source driving circuit 11 to drive the light source 2 to work according to the information about the constant brightness state and stably stores the information about the brightness state in the flash memory chip 1232, which specifically comprises that the current detecting module 121 obtains the connecting signal of the light source driving circuit and sends the connecting signal into the analyzing and processing module 122; and then the analyzing and processing module 122 preferably extracts the information about the brightness state in the memory chip 1231, generates the signal of controlling the light source driving circuit 11 to drive the light source 2 to work at the constant brightness state and stores the information about the brightness state which is prior stored in the memory chip 1231 into the flash memory chip 1232.

The light source driving circuit 11 is disconnected when the lights source 2 is working at the constant brightness state and thereafter connected before the temporary power supplying circuit 13 stops supplying the MCU 12 with electricity; and when the light source driving circuit 11 is connected, the MCU 12 eliminates the stably stored information about the brightness state, which specifically comprises disconnecting the light source driving circuit 11 when the light source 2 is working at the constant brightness state and starting to load the analyzing and processing module 122 with an instruction of preparing to eliminate the information about the brightness state in the flash memory chip 1232 when the light source driving circuit is disconnected, wherein the instruction stays before the temporary power supplying circuit 13 is drained and the instruction vanishes after the temporary power supplying circuit 13 is drained. When the instruction exists, the light source driving circuit 11 is connected once again; the current detecting module 121 obtains the connecting signal of the light source driving circuit 11 and sends the connecting signal into the analyzing and processing module 122; then the analyzing and processing module 122 eliminates the stably stored information about the brightness state; and since the information about the brightness state has been eliminated, the analyzing and processing module 122 extracts the firmware program to analyze and process and generates and sends the signal of driving the light source to gradually vary the brightness into the light source driving circuit 11. When the instruction vanishes, the light source driving circuit 11 is connected once again; the current detecting module 121 obtains the connecting signal of the light source driving circuit 11; the information about the brightness state stored in the flash memory chip 1232 is protected from being eliminated by the analyzing and processing module 122 because of the vanishing of the instruction of preparing to eliminate the stably stored information about the brightness state and thus still remains; and then the analyzing and processing module 122 extracts the information about the brightness state in the flash memory 1232 for analyzing and processing and generates and sends the signal of driving the light source to work at the constant brightness state into the light source driving circuit.

The connecting for the first time means connecting the light source driving circuit after the stored information about the brightness state is eliminated. Certainly, when the light source is working at the constant brightness state and after the light source driving circuit is disconnected, it is unnecessary for the MCU not to save the stored information about the brightness state until the light source driving circuit is connected after the temporary power supplying circuit stops supplying the MCU with electricity. The MCU can save the stored information about the brightness state when the light source driving circuit maintains being disconnected only for a certain period after being disconnected. The certain period can be different in specific situations and ranges approximately from 3 s to 10 s.

Fourth Preferred Embodiment

According to the third preferred embodiment of the present invention, the MCU is provided with the timing module 124 which obtains the period of the light source driving circuit 11 from connecting to disconnecting when the light source 2 is in the state of gradually varying the brightness and at the instant of disconnecting the light source driving circuit 11; and then the analyzing and processing module 122 searches the constant brightness state of the light source which corresponds to the period out in the predefined program and temporarily stores the information about the constant brightness state. Different from the third preferred embodiment, according to a fourth preferred embodiment, the MCU is provided with a signal sampling module 125 for obtaining at least one of a current value and a voltage value of the working light source 2 when the light source 2 is at the state of gradually varying the brightness and at the instant of disconnecting the light source driving circuit 11 and sending the obtained value or values into the analyzing and processing module 122 which stores the value or values in the storage module 123. The light source driving circuit 11 is accompanied by the energy storing element 111. The energy storing element 111 supplies the light source with unchanged current and voltage at the instant of disconnecting the light source driving circuit 11; meanwhile the current detecting module 121 sends out the disconnecting signal of the light source driving circuit 11 and the analyzing and processing module 122 sends the signal sampling module 125 the current value or the voltage value which is sent into the light source 2 by an output terminal of the light source driving circuit 11, wherein the current value and the voltage value correspond to the brightness state of the light source; and then the signal sampling module 125 obtains the current value or the voltage value of the light source 2 and sends the obtained current value or the obtained voltage value into the analyzing and processing module which stores the current value or the voltage value in the storage module. When the light source driving circuit is connected again, the analyzing and processing module extracts the current value or the voltage value for analyzing and processing and then generates the signal for controlling the light source driving circuit to drive the light source to work according to the current value or the voltage value.

According to the fourth preferred embodiment of the present invention, the current detecting module 121 detects current signal of an input terminal of the light source driving circuit 11 and the signal sampling module 125, different from the current detecting module 121, detects at least one of the current value and the voltage value of the output terminal of the light source driving circuit 11. Moreover, if the output terminal of the light source driving circuit is accompanied by no energy storing element 111, the light source driving circuit outputs zero current and zero voltage into the light source, and then the signal sampling module is unable to collect the current value or the voltage value of the working light source at the instant of disconnecting the light source driving circuit 11.

Meanwhile it is necessary to mention that, in the third preferred embodiment and the fourth preferred embodiment of the present invention, the current and the voltage sent into the MCU by the temporary power supplying circuit are required to maintain stable, in such a manner that the MCU is able to work effectively and ensure a stability of data. Thus the capacitor or the cell having a large capacity is preferred.

Based on the above principles of adjusting the brightness of the light source, colors of the light source can also be adjustable, just by replacing the firmware program with the colors varying according to a desire order. One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method for driving light adjustments, comprising:

for a first time connecting a light source driving circuit which supplies a light source and an MCU with electricity and driving the light source to gradually vary brightness according to a predefined firmware program by the light source driving circuit which is controlled by the MCU;

a temporary power supplying circuit continuing to supply the MCU with electricity after the light source driving circuit is disconnected;

when the light source is in a state of gradually varying the brightness and at an instant of disconnecting the light source driving circuit, the MCU obtaining an instant brightness state of the light source when the light source driving circuit is disconnected and the MCU temporarily storing information about the brightness state;

the temporarily stored information about the brightness state vanishing when the light source driving circuit is disconnected while the light source is gradually varying the brightness and after the temporary power supplying circuit stops supplying the MCU with electricity;

again connecting the light source driving circuit after the first time before the information about the brightness state vanishes, driving the light source to work according to the information about the brightness state by the light source driving circuit which is controlled by the MCU and the MCU stably storing up the information about the brightness state;

again connecting the light source driving circuit after the first time after the information about the brightness state vanishes and driving the light source to gradually vary the brightness according to the predefined firmware program by the light source driving circuit which is controlled by the MCU;

disconnecting the light source driving circuit when the light source is working according to the brightness state which is constant, connecting the light source driving circuit after the light source driving circuit is disconnected and the temporary power supplying circuit stops supplying the MCU with electricity and the MCU saving the stably stored information about the brightness state;

connecting the light source driving circuit after the information about the brightness state is eliminated and driving the light source to gradually vary the brightness according to the predefined firmware program by the light source driving circuit which is controlled by the MCU; and connecting the light source driving circuit after the information about the brightness state is saved and driving the light source to work according to the stably stored information about the brightness state by the light source driving circuit which is controlled by the MCU.

2. The method, as recited in claim 1, wherein the light source driving circuit is accompanied by an energy storing element which continues to supply the light source with electricity after the light source driving circuit stops supplying the light source with electricity.

3. The method, as recited in claim 1, wherein the step of "when the light source is in a state of gradually varying the brightness and at an instant of disconnecting the light source driving circuit the MCU obtaining an instant brightness state of the light source when the light source driving circuit is disconnected and the MCU temporarily storing information about the brightness state" comprises following steps of:

when the light source is in a state of gradually vary the brightness and at an instant of disconnecting the light source driving circuit, the MCU obtaining a period of the light source driving circuit from connecting to disconnecting, the MCU searching out a brightness state of the light source which corresponds to the period in the predefined firmware program and the MCU temporarily storing information about the brightness state.

4. The method, as recited in claim 2, wherein the step of "when the light source is in a state of gradually varying the brightness and at an instant of disconnecting the light source driving circuit the MCU obtaining an instant brightness state of the light source when the light source driving circuit is disconnected and the MCU temporarily storing information about the brightness state" comprises following steps of:

when the light source is in a state of gradually vary the brightness and at an instant of disconnecting the light source driving circuit, the MCU obtaining a period of the light source driving circuit from connecting to disconnecting, the MCU searching out a brightness state of the light source which corresponds to the period in the predefined firmware program and the MCU temporarily storing information about the brightness state.

5. The method, as recited in claim 2, wherein the step of "when the light source is in a state of gradually varying the brightness and at an instant of disconnecting the light source driving circuit the MCU obtaining an instant brightness state of the light source when the light source driving circuit is disconnected and the MCU temporarily storing information about the brightness state" comprises following steps of:

when the light source is in a state of gradually vary the brightness and at an instant of disconnecting the light source driving circuit, the MCU obtaining at least one of a current value and a voltage value of the light source driving circuit when the light source driving circuit is disconnected and the MCU temporarily storing the obtained value or the obtained values.

6. A device for driving light adjustments, comprising a light source driving circuit and further an MCU and a temporary power supplying circuit, wherein said temporary power supplying circuit is for supplying said MCU with electricity after said light source driving circuit stops supplying electricity; and said MCU comprises a current detecting module, an analyzing and processing module and a storage module, wherein said current detecting module is for obtaining a connecting signal or a disconnecting signal of said light source driving circuit and sending said obtained signal into said analyzing and processing module and said storage module is for storing a firmware program of gradually varying brightness of a light source and information about a constant brightness state of said light source; and said analyzing and processing module obtains said connecting signal or said disconnecting signal of said light source driving circuit and said firmware program of gradually varying said brightness of said light source or said information about said constant brightness state of said light source which is stored in said storage module for analyzing and processing, then generates a signal of adjusting said brightness of said light source and sends said signal into said light source driving circuit; and said light source driving circuit adjusts said brightness of said light source according to said signal, wherein after said light source driving circuit is connected for a first time, said analyzing and processing module generates a signal for controlling said light source driving circuit to drive said light source to gradually vary said brightness according to said predefined firmware program;

when said light source is in a state of gradually vary said brightness and after said light source driving circuit is disconnected, said analyzing and processing module obtains said constant brightness state at an instant of disconnecting said light source driving circuit and temporarily stores said information about said constant brightness state in said storage module;

when said light source driving circuit is disconnected while the light source is in said state of gradually varying said brightness and after said temporary power supplying circuit stops supplying said MCU with electricity, said temporarily stored information about said brightness state vanishes;

before said information about said brightness state vanishes, said light source driving circuit is connected again after the first time and said analyzing and processing module generates said signal for controlling said light source driving circuit to drive said light source to work according to said information about said constant brightness state and stably stores said information about said constant brightness state in said storage module;

after said information about said brightness state vanishes, said light source driving circuit is connected again after the first time and said analyzing and processing module generates said signal for controlling said light source driving circuit to drive said light source to gradually vary said brightness according to said predefined firmware program;

said light source driving circuit is disconnected when said light source is working at said constant brightness state and then connected before said temporary power supplying circuit stops supplying said MCU with electricity, and said analyzing and processing module eliminates said stably stored information about said brightness state when said light source driving circuit is connected;

said light source driving circuit is disconnected when said light source is working at said constant brightness state and then connected after said temporary power supplying circuit stops supplying said MCU with electricity, and said analyzing and processing module saves said stably stored information about said brightness state;

said light source driving circuit is connected after said information about said brightness state is eliminated and said analyzing and processing module generates said signal for controlling said light source driving circuit to drive said light source to gradually vary said brightness according to said predefined firmware program; and said light source driving circuit is connected after said information about said brightness state is saved and said analyzing and processing module generates said signal for controlling said light source driving circuit to drive said light source to work according to said stably stored information about said brightness state.

7. The device, as recited in claim 6, wherein said light source driving circuit is accompanied by an energy storing element which continues to supply said light source with electricity after said light source driving circuit stops supplying said light source with electricity.

8. The device, as recited in claim 6, wherein said MCU further comprises a timing module for obtaining a period of said light source driving circuit from connecting to disconnecting when said light source is in said state of gradually varying said brightness and at the instant of disconnecting said light source driving circuit; and said analyzing and processing module searches out said constant brightness state of said light source which corresponds to said period in said predefined firmware program and temporarily stores said information about said brightness state.

9. The device, as recited in claim 7, wherein said MCU further comprises a timing module for obtaining a period of said light source driving circuit from connecting to disconnecting when said light source is in said state of gradually varying said brightness and at the instant of disconnecting said light source driving circuit; and said analyzing and processing module searches out said constant brightness state of said light source which corresponds to said period in said predefined firmware program and temporarily stores said information about said brightness state.

10. The device, as recited in claim 7, wherein said MCU further comprises a signal sampling module for obtaining at least one of a current value and a voltage value of an output terminal of said light source driving circuit when said light source is at said state of gradually varying said brightness and at the instant of disconnecting said light source driving circuit; and said analyzing and processing module stores said current value and said voltage value in said storage module.

11. A light adjustable lamp, comprising a light source and the device as recited in claim 6 which is connected to said light source.

* * * * *